US005360172A

United States Patent [19]

Wang

[11] Patent Number: 5,360,172

[45] Date of Patent: Nov. 1, 1994

[54] DEVICE FOR CONTROLLING INCOMING/OUTGOING OF WATER FLOW OF A SPRINKLER

[75] Inventor: King Y. Wang, Changhua Hsien, Taiwan, Prov. of China

[73] Assignee: Yuan Mei Corp., Changhua Hsien, Taiwan, Prov. of China

[21] Appl. No.: 234,363

[22] Filed: Apr. 28, 1994

[51] Int. Cl.[5] ..... B05B 1/30

[52] U.S. Cl. ..... 239/586; 239/530; 239/583; 251/263

[58] Field of Search ..... 239/530, 583, 586; 251/257, 263

[56] References Cited

U.S. PATENT DOCUMENTS

| | | | |
|---|---|---|---|
| Re. 26,013 | 5/1966 | Lennon | 239/583 |
| 992,375 | 5/1911 | Moffitt | 251/257 |
| 1,048,825 | 12/1912 | Griffiths | 251/257 |
| 2,580,553 | 1/1952 | King | 251/263 |
| 3,042,312 | 7/1962 | Packard | 239/586 |
| 3,637,143 | 1/1972 | Shames et al. | 239/530 |
| 4,128,209 | 12/1978 | Johnson | 239/583 |
| 4,629,124 | 12/1986 | Gruber | 239/586 |
| 5,248,097 | 9/1993 | Kardell | 239/583 |

FOREIGN PATENT DOCUMENTS

| | | | |
|---|---|---|---|
| 5399 | 3/1909 | United Kingdom | 239/583 |

*Primary Examiner*—Andres Kashnikow
*Assistant Examiner*—Christopher G. Trainor
*Attorney, Agent, or Firm*—Browdy and Neimark

[57] ABSTRACT

A device for controlling incoming/outgoing of water flow of a sprinkler, comprising a control tube, a control pin, a pushing block, a frame member and a spring, wherein the control tube has a water incoming end and a water outgoing end and an outer surface of the control tube is formed with a rectangular recess. A pin chamber is disposed at a middle section of the recess and extends downward therefrom. The pin chamber having a first side wall formed with a water inlet, a second side wall formed with a water outlet, and a bottom wall formed with a communicating hole. The control pin has a substantially semispherical head section and three projecting ring sections. Each ring section of the control pin is formed with an annular groove receiving a sealing ring. The pushing block has a bottom face formed with a depression, two lateral projecting ribs, and an inclined wall located in the depression. The frame member is formed with an elliptic hole and a rectangular peripheral groove surrounding the elliptic hole. The switching operation of the present invention can be easily performed by single hand without using great force.

1 Claim, 6 Drawing Sheets

DEVICE FOR CONTROLLING INCOMING/OUTGOING OF WATER FLOW OF A SPRINKLER

BACKGROUND OF THE INVENTION

The present invention relates to a device for controlling incoming/outgoing of water flow of a sprinkler, which is mainly composed of a control tube, a control pin fitted into the control tube for controlling the water flow, a pushing block for urging the control pin to move to a lower opening position, a frame member with which the pushing block is slidably associated, and a spring for restoring the control pin to an upper closing position. The above elements are assembled in such a manner that the spring and control pin are first fitted into a pin chamber of the control tube and the pushing block is fitted into the frame member from a bottom side thereof. Then the frame member is affixed on a rectangular recess of the control tube, whereby the pushing block can be switched to displace the control pin between the lower opening position and the upper closing position so as to control the incoming/outgoing of the water flow of a sprinkler in a simpler manner.

A conventional water flow controlling device of a sprinkler mostly includes a ball valve switch which must be operated in such a manner that one hand of a user holds the sprinkler and the other hand swivels a butterfly tap of the ball valve switch so as to control the opening/closing of the sprinkler. Scuh procedure is inconvenient to the user and is laborious. Moreover, the water flow cannot be easily controlled by swiveling the butterfly tap and the manufacturing cost of the ball valve switch is considerably high.

Therefore, it is necessary to provide an improved water flow controlling device of a sprinkler, which is manufactured at low cost and can be easily operated by single hand to control the incoming/outgoing of water flow without using great force.

SUMMARY OF THE INVENTION

It is therefore a primary object of the present invention to provide an improved water flow controlling device of a sprinkler, which can be easily operated by single hand to control the incoming/outgoing of water flow without using great force.

It is a further object of the present invention to provide the above controlling device which is manufactured at low reduced cost.

According to the above object, the controlling device comprises a control tube, a control pin, a pushing block, a frame member and a spring, wherein the control tube has a water incoming end and a water outgoing end and an outer surface of the control tube is formed with a rectangular recess. A pin chamber is disposed at a middle section of the recess and extends downward therefrom. The pin chamber having a first side wall formed with a water inlet, a second side wall formed with a water outlet, and a bottom wall formed with a communicating hole. The control pin has a substantially semispherical head section and three projecting ring sections. Each ring section of the control pin is formed with an annular groove receiving a sealing ring. The pushing block has a bottom face formed with a depression, two lateral projecting ribs, and an inclined wall located in the depression. The frame member is formed with an elliptic hole and a rectangular peripheral groove surrounding the elliptic hole. The spring and control pin are fitted into the pin chamber of the control tube and the pushing block is fitted into the frame member from a bottom side thereof. The frame member is affixed on the rectangular recess of the control tube, so that the pushing block is switchable to displace the control pin between a lower opening position and an upper closing position so as to control incoming/outgoing of water flow of the sprinkler.

The present invention can be best understood through the following description and accompanying drawings, wherein:

DETAILED DESCRIPTION OF THE PREFERRED EMBODIMENT

Figure 1:
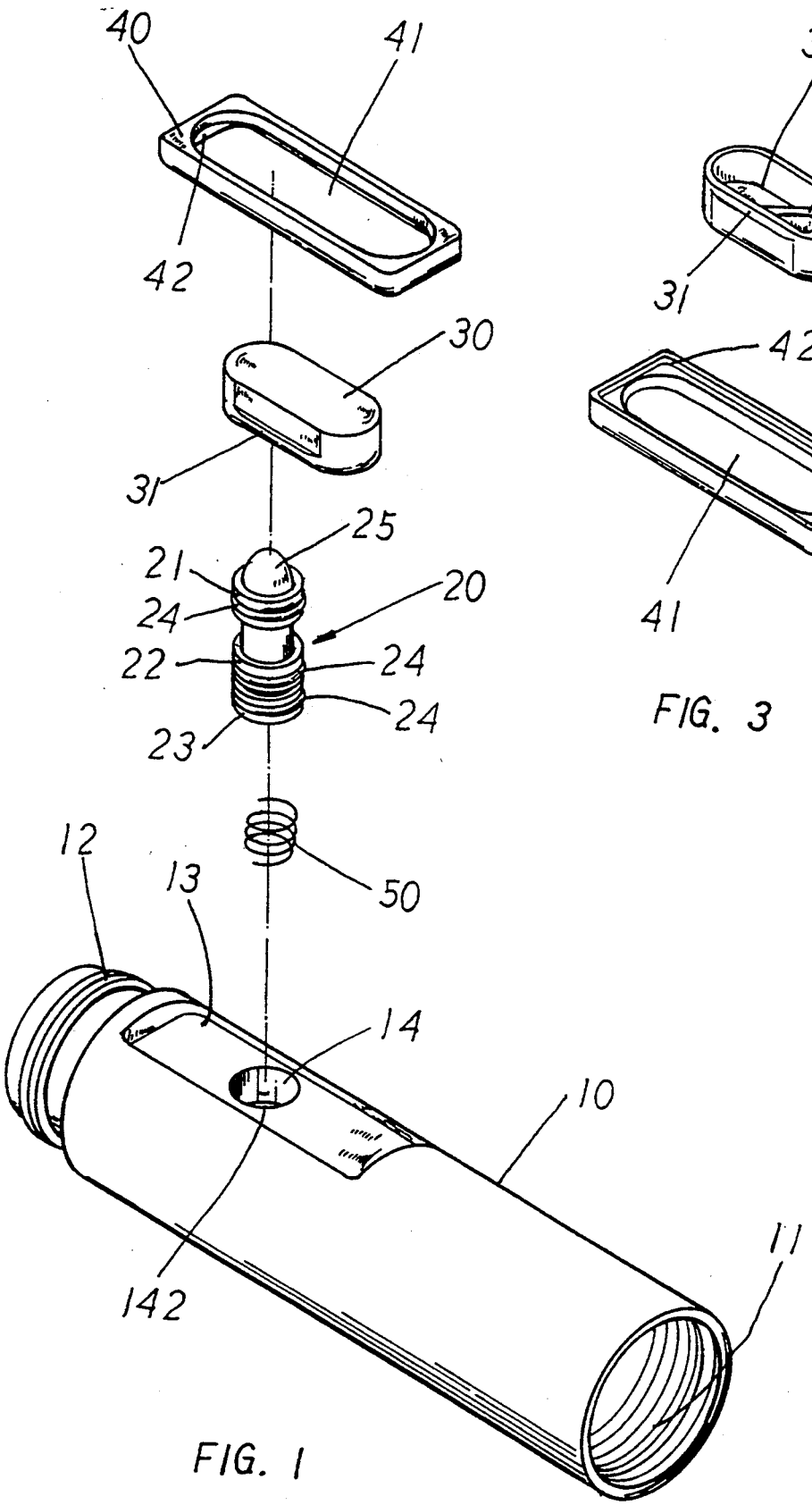
FIG. 1 is a perspective exploded view of the present invention.
Figure 3:
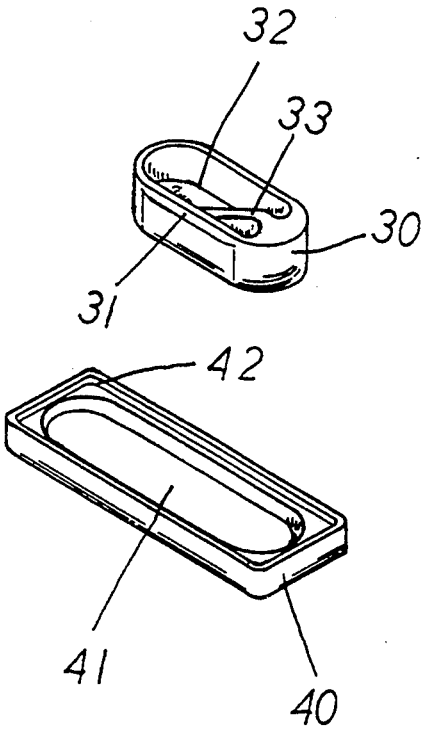
FIG. 3 is a perspective bottom view of the pushing block and frame member of the present invention.
Figure 2:
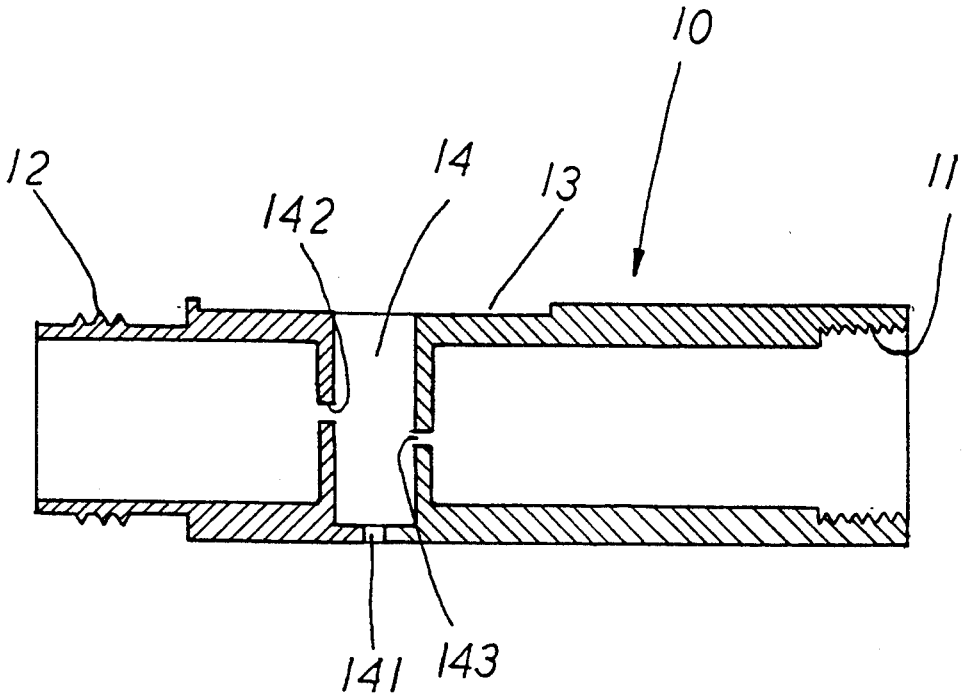
FIG. 2 is a sectional view of the control tube of the present invention.
Figure 4:
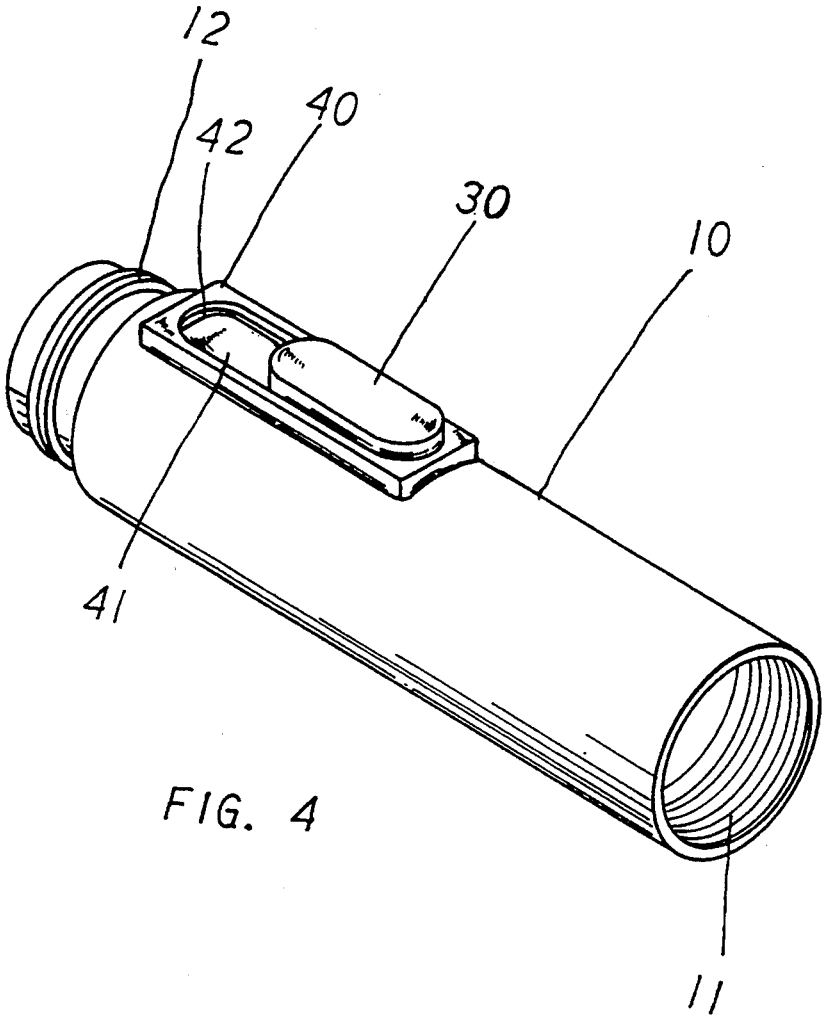
FIG. 4 is a perspective assembled view of the present invention.

Please refer to FIGS. 1, 2 and 3. The controlling device of the present invention mainly includes a control tube 10, a control pin 20 fitted into the control tube 10 for controlling the water flow, a pushing block 30 for urging the control pin 20 to move to a lower opening position, a frame member 40 with which the pushing block 30 is slidably associated, and a spring 50 for restoring the control pin 20 to an upper closing position. The control tube 10 has a water incoming end formed with inner thread 11 and a water outgoing end formed with outer thread 12. Moreover, the outer surface of the control tube 10 is formed with a rectangular recess 13 and a pin chamber 14 is disposed at a middle section of the recess 13 and extends downward therefrom. The pin chamber 14 has a first side wall formed with a water inlet 143 located at a middle lower section thereof, a second side wall formed with a water outlet 142 located at a middle upper section thereof, and a bottom wall formed with a communicating hole 141.

The control pin 20 has a substantially semispherical head section 25, a first projecting ring section 21 formed with an annular groove and located at an upper section of the control pin 20, a second projecting ring section 22 formed with an annular groove and located at a lower section of the control pin 20, and a third projecting ring section 23 formed with an annular groove and located at the lower section of the control pin 20 below the second projecting ring section 22. A water sealing ring 24 is disposed in each annular groove.

The pushing block 30 has a bottom face formed with a depression 32, two lateral projecting ribs 31, and an inclined wall 33 located in the depression 32.

The frame member 40 is formed with an elliptic hole 41 and a rectangular peripheral groove 42 surrounding the elliptic hole 41.

According to the above arrangements, the present invention is assembled in such a manner that the spring 50 is first placed into the pin chamber 14 of the control tube 10 and then the control pin 20 is fitted into the pin chamber 14 on the spring 50. Thereafter, the pushing block 30 is fitted into the elliptic hole 41 of the frame member 40 from a bottom side thereof with the lateral projecting ribs 31 slidably engaged with the peripheral groove 42 of the frame member 40. Finally, the frame member 40 is affixed on the rectangular recess 13 of the control tube 10.

Figure 5:
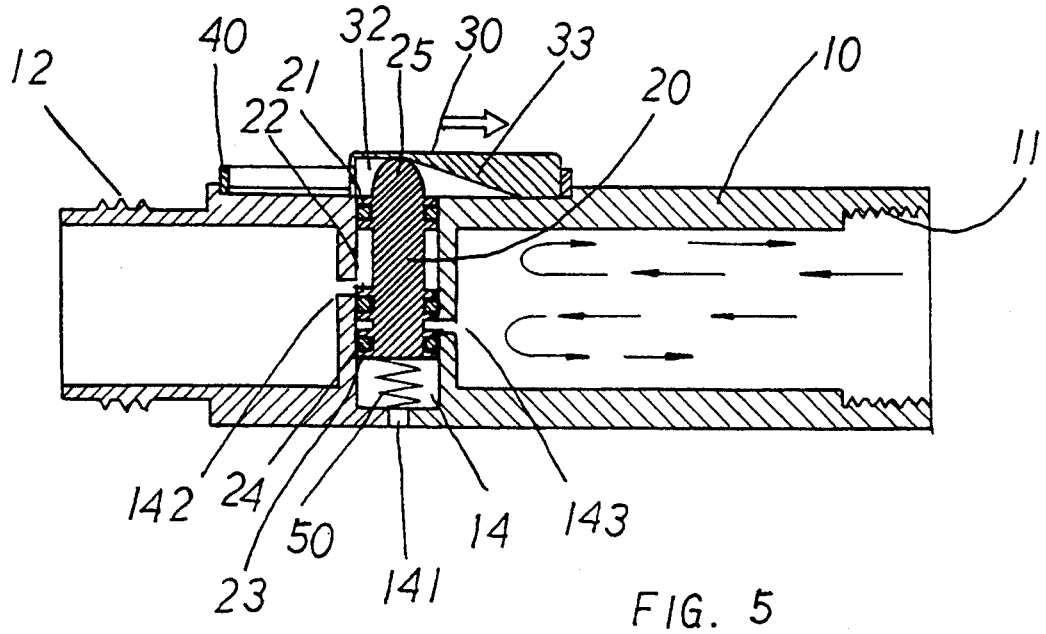
FIG. 5 is a sectional assembled view of the present invention in a closing state.

Please refer to FIG. 5. In a closing state, the pushing block 30 is pushed to a rear side of the frame member 40 and the control pin 20 is urged upward to a closing position by the spring 50 with the head section 25 abutting against a top end of the inclined wall 33. At this time, the second projecting ring section 22 with the water sealing ring 24 blocks the passage between the water inlet 143 and the water outlet 142 of the pin chamber 14 so that the water cannot pass through the control pin 20 and flow out of the water outgoing end of the control tube 10. The communicating hole 141 of the pin chamber 14 avoids a vacuum between a bottom face of the control pin 20 and the bottom wall of the pin chamber 14.

Figure 6:
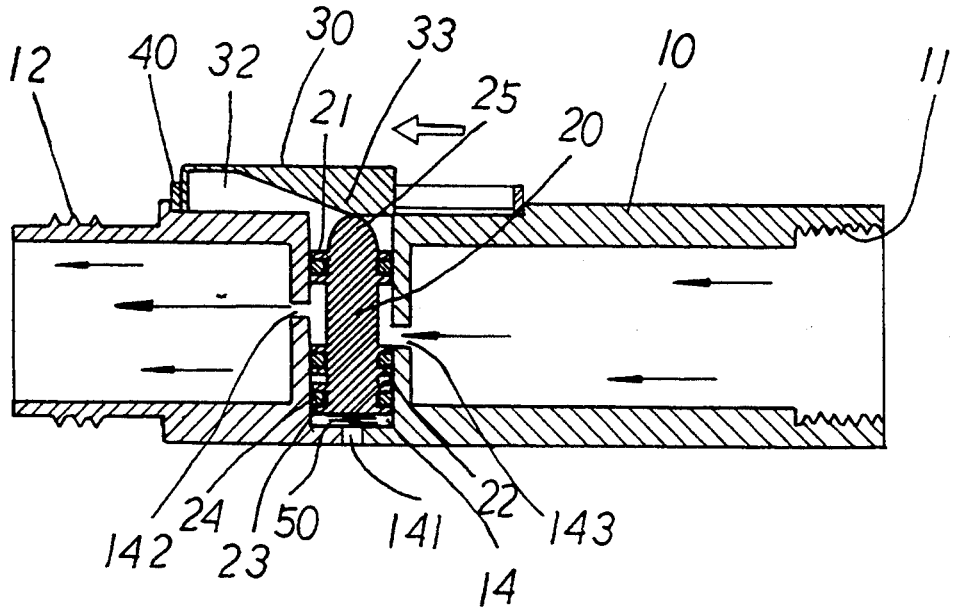
FIG. 6 is a sectional assembled view of the present invention in an opening state.

Please refer to FIG. 6. In an opening state, the pushing block 30 is pushed to a front side of the frame member 40 with the inclined wall 33 of the pushing block 30 passing through the head section 25 of the control pin 20 and thus pressing down the control pin 20 to an opening position. At this time, the spring 50 is contracted and the second projecting ring section 22 with the water sealing ring 24 is moved downward to free the passage between the water inlet 143 and water outlet 142. Therefore, the water is permitted to flow from the water inlet 143 through the control pin 20 out of the water outlet 142.

Figure 7:
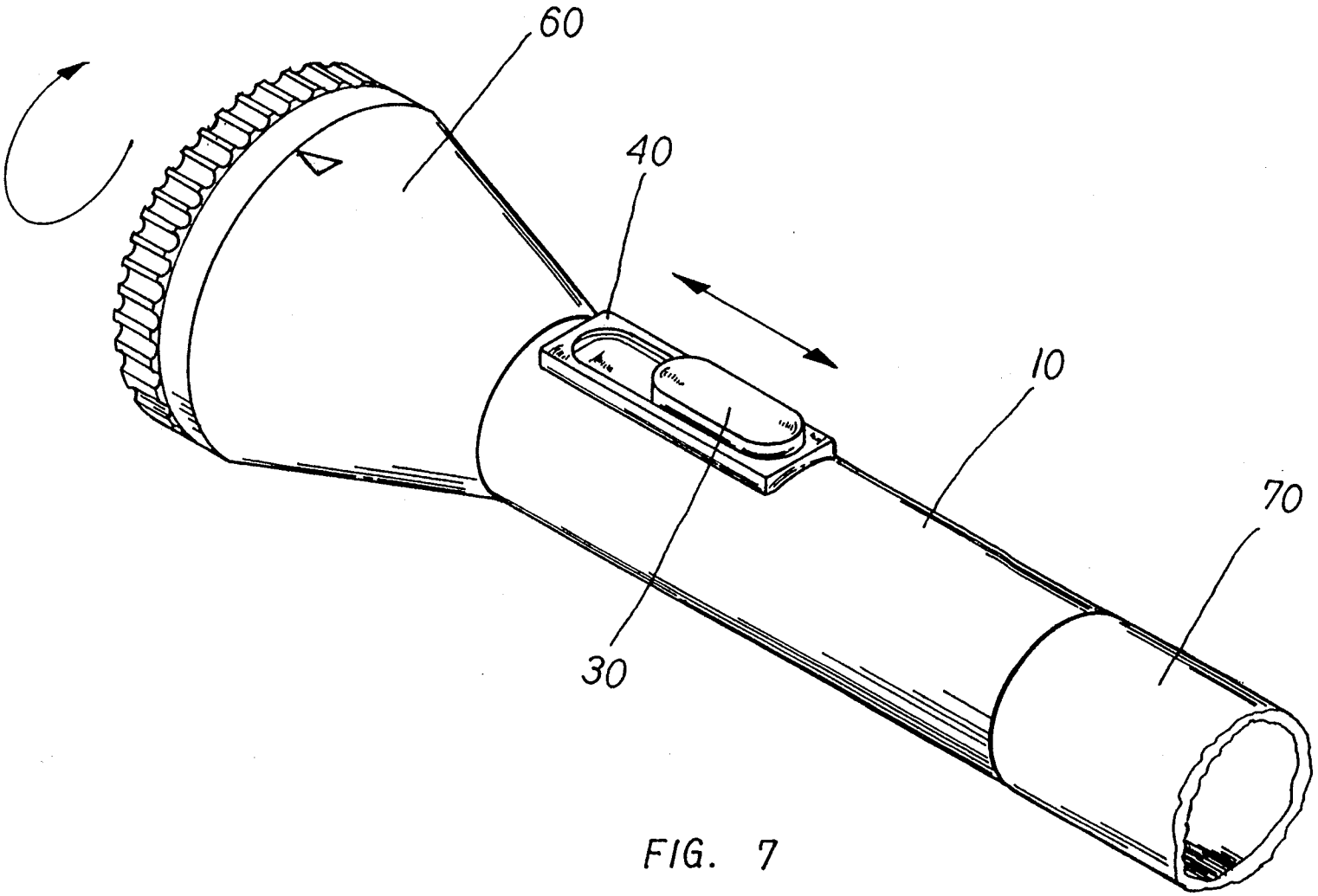
FIG. 7 shows that the present invention is associated with a sprinkling head and a water incoming tube.

Please refer to FIG. 7. An adjustable sprinkling head 60 having an inner thread can be screwed on the outer thread 12 of the water outgoing end of the control tube 10 and a water incoming tube 70 having an outer thread can be screwed on the inner thread 11 of the water incoming end of the control tube 10. The adjustable sprinkling head 60 can be rotated to vary the pattern of sprinkling for sprinkling water onto flowers or leaves.

Figure 8:
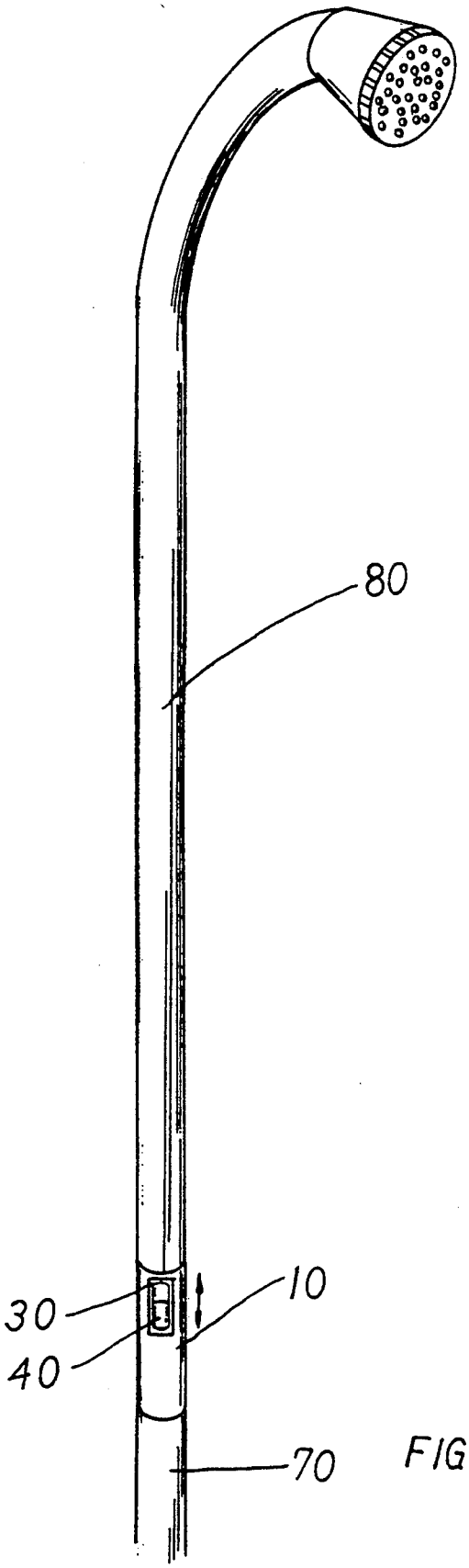
FIG. 8 shows that the present invention is associated with a sprinkling pipe and a water incoming tube.

Please refer to FIG. 8. Alternatively, a sprinkling pipe 80 can be screwed on the outer thread 12 of the control tube 10 and the water incoming tube 70 can be screwed on the inner thread 11 of the control tube 10 for sprinkling water onto a car.

The advantages of the present invention are as follows:

1. The switching operation of the present invention can be easily performed by single hand without using great force.
2. The components of the present invention are simple and the manufacturing cost thereof is relatively low.

The above embodiment is only an example of the present invention and the scope of the present invention should not be limited to the example. Any modification or variation derived from the example should fall within the scope of the present invention.

What is claimed is:

1. A device for controlling incoming/outgoing of water flow of a sprinkler, comprising a control tube, a control pin fitted into said control tube for controlling water flow, a pushing block for urging said control pin to move to a lower opening position, a frame member with which said pushing block is slidably associated, and a spring for restoring said control pin to an upper closing position, wherein:

said control tube has a water incoming end and a water outgoing end, an outer surface of said control tube being formed with a rectangular recess and a pin chamber being disposed at a middle section of said recess and extends downward therefrom, said pin chamber having a first side wall formed with a water inlet, a second side wall formed with a water outlet, and a bottom wall formed with a communicating hole;

said control pin has a substantially semispherical head section, a first projecting ring section formed with an annular groove and located at an upper section of said control pin, a second projecting ring section formed with an annular groove and located at a lower section of said control pin, and a third projecting ring section formed with an annular groove and located at said lower section of said control pin below said second projecting ring section, a water sealing ring being disposed in each annular groove;

said pushing block has a bottom face formed with a depression, two lateral projecting ribs, and an inclined wall located in said depression;

said frame member is formed with an elliptic hole and a rectangular peripheral groove surrounding said elliptic hole, Whereby said spring and control pin are fitted into said pin chamber of said control tube and said pushing block is fitted into said frame member from a bottom side thereof, and said frame member is affixed on said rectangular recess of said control tube, so that said pushing block is switchable to displace said control pin between said lower opening position and said upper closing position so as to control incoming/outgoing of water flow of the sprinkler.

* * * * *